US006497590B1

(12) United States Patent
Hsu

(10) Patent No.: US 6,497,590 B1
(45) Date of Patent: Dec. 24, 2002

(54) VEHICLE LIGHT BULB

(75) Inventor: Chin-Shui Hsu, Hsinchu (TW)

(73) Assignee: Everlite Electric Industries Corp., Hsinchu (TW)

( * ) Notice: Subject to any disclaimer, the term of this patent is extended or adjusted under 35 U.S.C. 154(b) by 0 days.

(21) Appl. No.: 09/939,734

(22) Filed: Aug. 28, 2001

(51) Int. Cl.[7] ..... H01R 17/00
(52) U.S. Cl. ..... 439/619; 439/699.2; 313/318.07
(58) Field of Search ..... 439/619, 699.2, 439/617, 638–655, 544; 315/315, 318; 313/318.07, 318.09, 318.06, 113, 323, 324; 362/226

(56) References Cited

U.S. PATENT DOCUMENTS 4,603,278 A * 7/1986 Devir et al. ..... 313/318
5,531,613 A * 7/1996 Takano et al. ..... 439/544
6,083,050 A * 7/2000 Hsu ..... 439/619

* cited by examiner

*Primary Examiner*—P. Austin Bradley
*Assistant Examiner*—Alexander Gilman
(74) *Attorney, Agent, or Firm*—Rabin & Berdo, P.C.

(57) ABSTRACT

A vehicle light bulb has a glass bulb and a base for receiving the glass bulb. A flat portion is used to seal a bottom of the glass bulb, and at least one filament is provided inside the bulb and connected between two legs that extend out the flat portion. The base is mainly made up of a holder and a plate extending from a bottom of the holder, wherein the holder has a top defined with a slot for receiving the flat portion. At least two apertures are defined in a bottom of the plate. When the glass bulb is received in the base, the two legs individually extend through the apertures so as to electrically connect in a socket of a vehicle light, such as a brake light.

2 Claims, 4 Drawing Sheets

VEHICLE LIGHT BULB

BACKGROUND OF THE INVENTION

1. Field of Invention

The present invention relates to a vehicle light bulb applied to automobiles and other types of vehicles.

2. Related Art

With reference to FIG. 5, a conventional automobile light bulb comprises a glass bulb (40) and a base (41) that securely receives the glass bulb (40) therein. Two filaments (42,42') each connected between two respective conducting legs (43*a*, 43*b*, 43*c*, 43*d*) are provided in the glass bulb (40), wherein each conducting leg (43*a*, 43*b*, 43*c*, 43*d*) has a wire (not shown) that extends into the base (41). Usually, the wires extending from the conducting legs (43*a*, 43*c*) are connected together to form a common wire. When the glass bulb (40) is adhered to the base, the common wire is disposed to electrically connect with the inner wall of the base (41), wherein the base (41) is made of conductive material and is used as one electrode, such as a cathode. Other wires, which extend from the conducting legs (43*b*, 43*d*), are electrically connected to a conductive point (44) formed on the bottom of the base (41), wherein the conductive point (44) is used as the other electrode, such as an anode.

When the conventional automobile light bulb is being installed in a socket of a signal light, such as a brake light or a turn signal, the base (41) and the conductive point (44) are respectively and electrically connected to the cathode and anode of the socket. Thus the automobile light bulb is activated when the socket is provided with power.

However, such a structure of the conventional light bulb has some defects that need to be overcome. When the glass bulb (40) is adhered with the base (41) by using viscose, one essential point is that the common wire must be electrically connected with the base (41) well, if not, the light bulb will not light up.

Another defect appears at the time when the conventional light bulb is being installed in the socket. With reference to FIG. 5, two stubs (45) are further symmetrically formed on an outer periphery of the base (41). The installation of the light bulb into the socket is as follows. The glass bulb (40) is gripped by a user and the base (41) is pushed into the socket, whereafter the glass bulb (40) is rotated so as to find a proper position whereby the two stubs (45) are able to engage with the corresponding mechanism in the socket.

Since the connection between the glass bulb (40) and the base (45) is only achieved by the viscose, once the light bulb has been installed and detached from the socket several times, the glass bulb (40) and the base (45) may separate due to the torque between the bulb and the base. An even worse situation is that once the light bulb is damaged and needs to be replaced with a new one, the separated base (44) may possibly still remain in the socket and be very hard to take out, thus the replacement of the light bulb becomes very difficult.

Therefore, the present invention provides a vehicle light bulb to mitigate and/or obviate the aforementioned problems.

SUMMARY OF THE INVENTION

The main objective of the invention is to provide a vehicle light bulb that is convenient to install in or detach from a socket of a signal light in a vehicle.

Other objects, advantages and novel features of the invention will become more apparent from the following detailed description when taken in conjunction with the accompanying drawings.

DETAILED DESCRIPTION OF THE INVENTION

Figure 1:
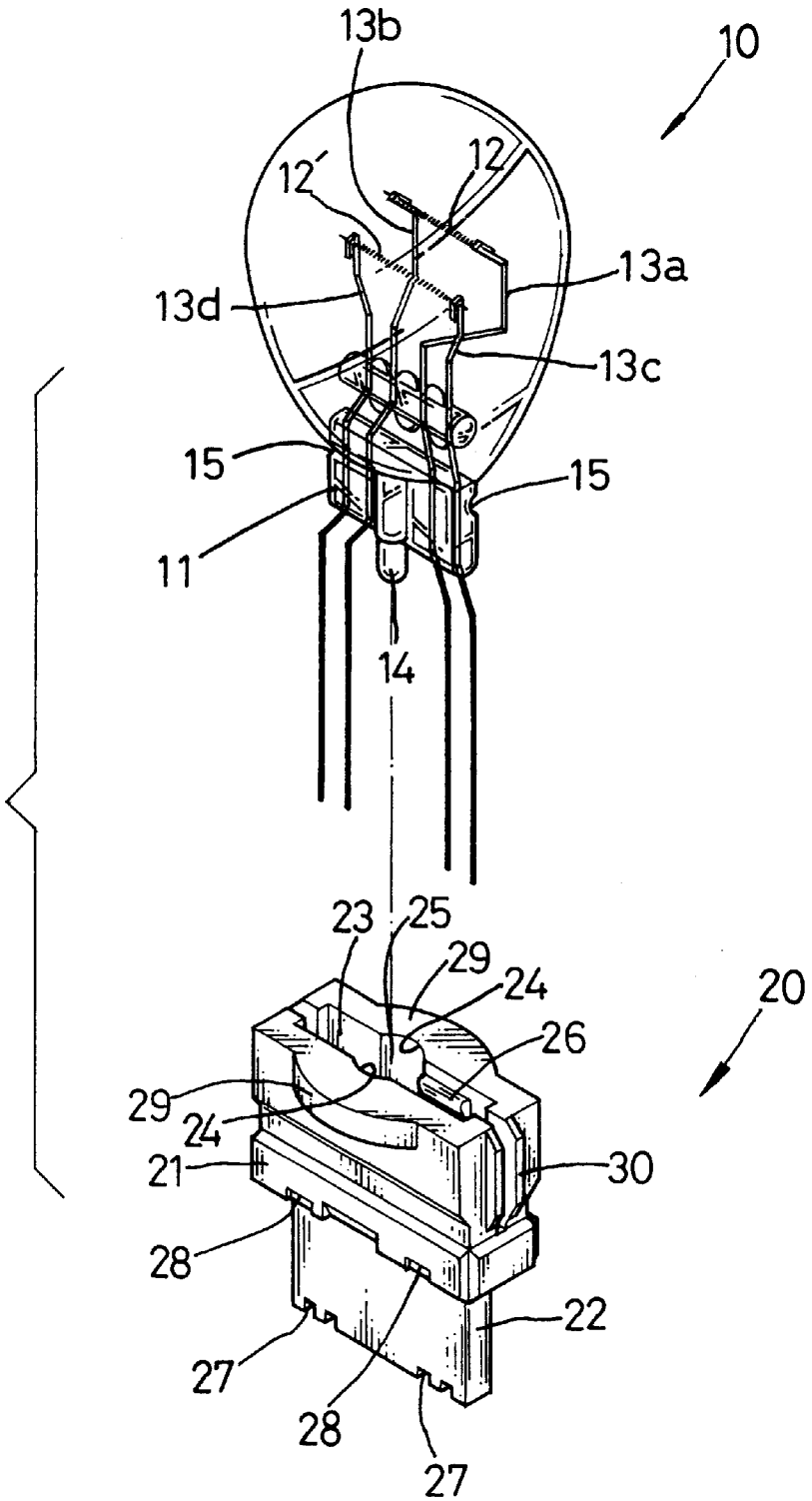
FIG. 1 is an exploded perspective view of a vehicle light bulb in accordance with the present invention.
Figure 2:
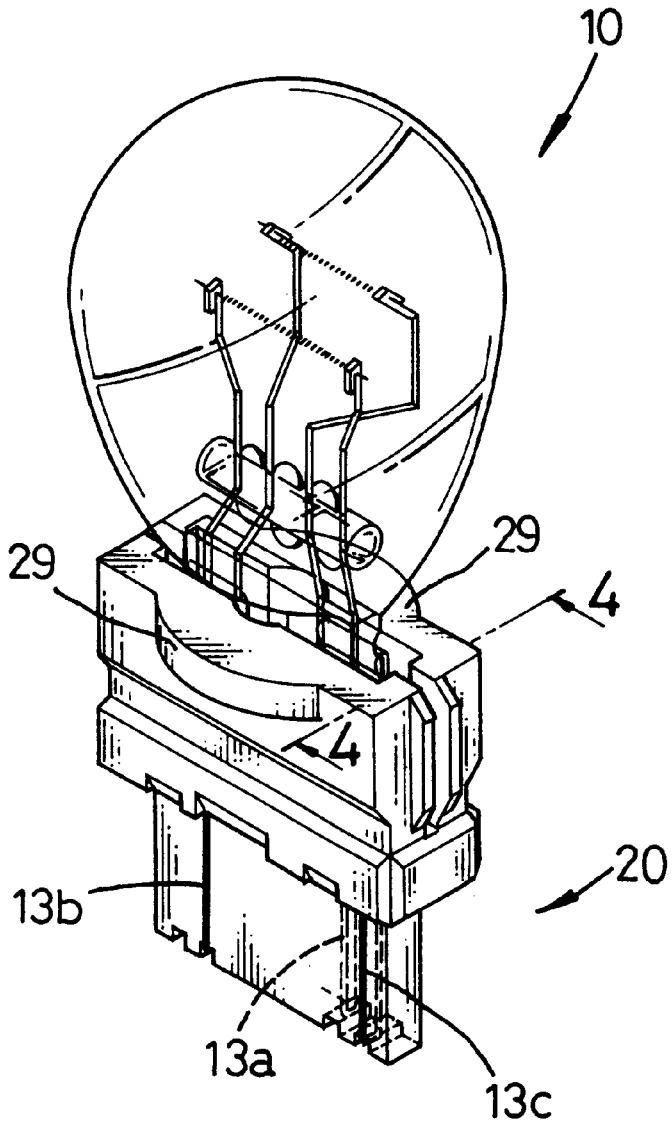
FIG. 2 is a perspective view of the vehicle light bulb shown in FIG. 1.

With reference to FIGS. 1 and 2, a vehicle light bulb comprises a glass bulb (10) and a base (20). The glass bulb (10) has a bottom where a flat portion (11) extends out. Two filaments (12, 12'), each connected between paired legs (13*a*, 13*b*, 13*c*, 13*d*) that extend through the flat portion (11), are provided inside the glass bulb (10). A column portion (14) is formed at a bottom of the flat portion (11). The flat portion (11) further has two grooves (15) defined at opposite sides thereof.

The base (20) comprises a holder (21) and a plate (22) extending from a bottom of the holder (21). A slot (23) is defined at a top of the holder (2), wherein two arcuate trenches (24) are respectively defined at opposite sidewalls defining the slot (23) to define a cylindrical channel (25). Further, two flanges (26) are respectively provided at the opposite sidewalls defining the slot (23) to correspond to the two grooves (15) of the flat portion (11). Two arcuate steps (29) and a plurality of ribs (30) are integrally formed around the outer surface of the holder (21) for engagement with a socket (not shown) of a vehicle light, such as a signal light or a brake light, when the vehicle light bulb is installed in the socket.

Figure 3:
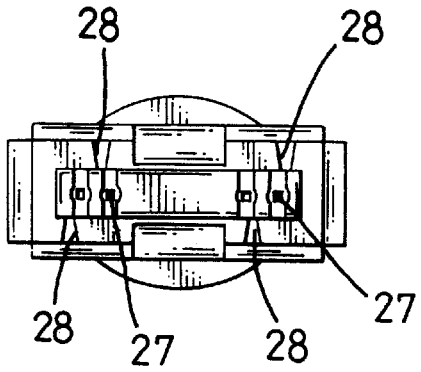
FIG. 3 is a bottom plan view of a base of the vehicle light bulb in accordance with the present invention.

With reference to FIG. 3, four apertures (27) are further defined in a bottom of the plate (22). Four notches (28) each substantially in alignment with a respective one of the apertures (27) are provided at the bottom of the holder (21), wherein the four notches (28) are oppositely disposed at the bottom of the holder (21) in pairs.

Figure 4:
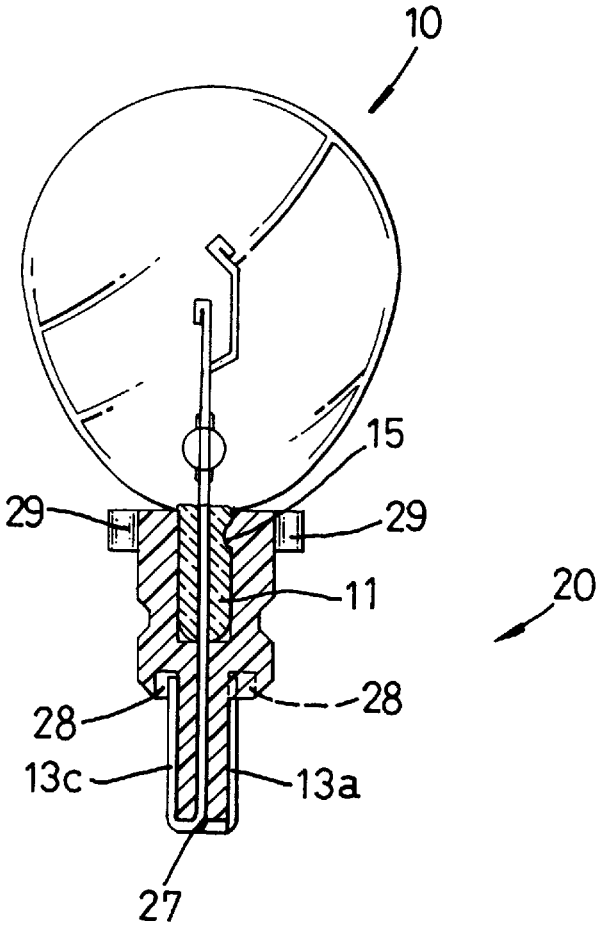
FIG. 4 is a partial cross-sectional view of the vehicle light bulb shown in FIG. 2.
Figure 5:
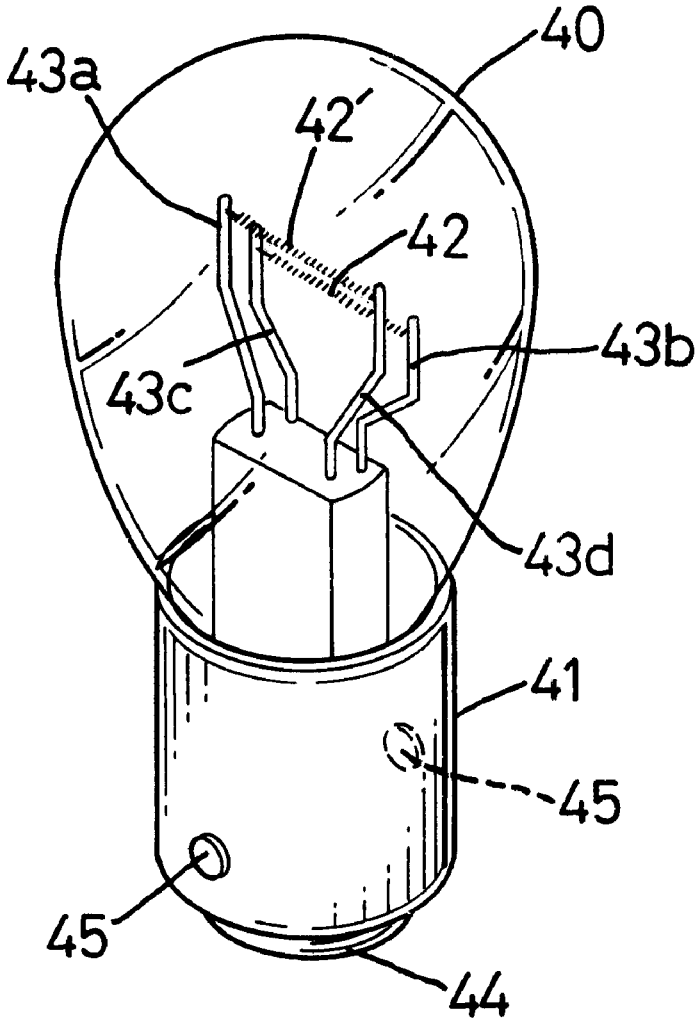
FIG. 5 PRIOR ART
FIG. 5 is a perspective view of a conventional vehicle light bulb.

With reference to FIG. 4, when the glass bulb (10) is assembled with the base (20) together, the flat portion (11) is inserted into the slot (23), and the column portion (14) is received in the cylindrical channel (25). Furthermore, the two flanges (26) are correspondingly received in the two grooves (15). Meanwhile, the legs (13*a*, 13*b*, 13*c* and 13*d*) extend through the four apertures (27) correspondingly. Then each leg (13*a*, 13*b*, 13*c* and 13*d*) is bent upward to be received in the notch (28) with its free end.

When the vehicle light bulb in accordance with the present invention is installed in the socket (not shown), the arcuate steps (29) and the plurality of ribs (30) formed at the outer surface are engaged with the socket, and the legs (13*a*, 13*b*, 13*c* and 13*d*) are electrically connected with a cathode and an anode in the socket so as to receive the power.

From the foregoing description, the invention has the following advantages.

Since the legs used for electrical connection with the socket are provided at the outside of the base, the legs are in direct contact with the cathode and anode in the socket so as to provide a good electrically connection.

The invention may be varied in many ways by a skilled person in the art. Such variations are not to be regarded as a departure from the spirit and scope of the invention, and all such modifications are intended to be included within the scope of the following claims.

What is claimed is:

1. A vehicle light bulb comprising:

a glass bulb having a bottom sealed with a flat portion, two legs extending out from the flat portion and at least one filament provided inside the glass bulb and connected between the two legs;

a base detachably connected with the glass bulb and having a holder and a plate that extends from a bottom of the holder, wherein the holder has a top defined with a slot for receiving the flat portion of the glass bulb and has two arcuate steps and multiple ribs formed at the outer surface of the holder and defining a continuation of the slot, said steps and said ribs are adapted to engage with a socket, wherein the plate having a bottom defined with at least two apertures so as to allow the two legs to extend through the at least two apertures to electrically connect with the socket;

wherein the flat portion further has two grooves respectively defined at two opposite sides of the flat portion, and two flanges are respectively provided at opposite sidewalls defining the slot, whereby when the glass bulb is inserted into the slot, the two flanges are correspondingly received in the two grooves so as to secure the glass bulb with the base;

wherein the bottom of the holder further has a plurality of notches, whereby when the two legs extend through the at least two apertures, each of the two legs is able to be bent upwardly and received in one of the plurality of notches with its free end.

2. The vehicle light bulb as claimed in claim 1, wherein the flat portion further has a column portion extending from a bottom of the flat portion, and two arcuate trenches are individually defined at the two opposite sides defining the slot so as to define a cylindrical channel for receiving the column portion.

* * * * *